United States Patent [19]

Luedtke

[11] Patent Number: 4,918,897

[45] Date of Patent: Apr. 24, 1990

[54] CONSTRUCTION SYSTEM FOR DETENTION STRUCTURES AND MULTIPLE STORY BUILDINGS

[76] Inventor: Charles W. Luedtke, 110 Bransford Rd., NE., Atlanta, Ga. 30342

[21] Appl. No.: 106,542

[22] Filed: Oct. 6, 1987

[51] Int. Cl.[5] ..... E04B 1/00

[52] U.S. Cl. ..... 52/747; 52/741; 52/657; 52/291

[58] Field of Search ..... 52/657, 293, 291, 747, 52/741

[56] References Cited

U.S. PATENT DOCUMENTS

| | | | |
|---|---|---|---|
| 1,536,717 | 5/1925 | Krekel | 52/657 |
| 1,850,118 | 3/1932 | Meyers | 52/657 |
| 1,877,898 | 9/1932 | Kotrbaty | 52/293 |
| 2,083,781 | 6/1937 | Groves | 52/293 |
| 2,088,310 | 7/1937 | Soule | 52/293 |
| 2,104,870 | 1/1938 | Levy | 52/293 |
| 2,126,309 | 8/1938 | Cade | 52/293 |
| 2,856,646 | 10/1958 | Latimer | 52/657 |
| 4,267,682 | 5/1981 | Fowler | 52/657 |

*Primary Examiner*—Henry E. Raduazo

*Attorney, Agent, or Firm*—Thomas & Kennedy

[57] ABSTRACT

A method of constructing multiple story buildings and particularly detention structures as disclosed in which the framing members are lightweight steel channel members which are generally similar and in certain applications, interchangeable. The walls and floors of the building are framed with the channel members and lath sheathing is applied thereto for receiving cementitious fill therebetween. A unique diagonal tension strap system is used whereby diagonal straps are permanently attached at their lower end and tensioned at their upper end with adjustable fasteners before being permanently fastended at the upper end. The system provides for a more rapid and inexpensive construction schedule over conventional construction and affords high resistance to fire and to penetration of the filled walls.

7 Claims, 8 Drawing Sheets

CONSTRUCTION SYSTEM FOR DETENTION STRUCTURES AND MULTIPLE STORY BUILDINGS

BACKGROUND OF THE INVENTION

Construction of detention structures has been subject of intensive research due to the need for large quantities of jail space. The requirements of resistance to penetration of the enclosure as well as its need to be fire resistant have generated pre-cast concrete systems as the primary alternative to the standard techniques of formed cast in place concrete, all steel construction or reinforced unit masonry. Reinforced unit masonry is the least resistant to penetration, is subject to joint damage by abrading and is a slow and labor intensive method. Cast in place reinforced concrete can be made acceptably resistant to penetration if heavily reinforced, but is slow due to forming, stripping and curing time requirements, and it is labor intensive, space consuming and very heavy. Pre-cast systems can be built with greater speed than the cast in place concrete but otherwise have the same type of deficiencies, plus they require many special connectors as well as heavy equipment for erection. All steel systems are the most resistant to penetration or damage but are not fire resistant enough for most multi-story structures and are very expensive. The system of this invention overcomes these difficulties by being highly resistant to penetration, lighter weight, fire resistant, easy and fast to erect and highly efficient in use of materials and labor. This invention also provides a joint free cell interior.

Recent tests run on the herein described cementiciously filled light gauge steel structure invention have shown it to be more resistant to penetration than reinforced concrete or reinforced unit masonry. The standard impact test simulates an average man swinging a sixteen pound sledge hammer at one point of the assembly. A six inch thick reinforced concrete wall was penetrated with 1300 blows and an eight inch reinforced unit masonry wall with 800 blows. The light gauge metal sheathed and cementiciously filled wall described in this invention withstood an average of 1982 blows with only minor and easily repairable damage.

Light gauge steel framing used in this invention has been produced by many manufacturers since the late 1940's and is used in both load bearing and non-load bearing construction. It is normally used with finishes on both sides and a hollow or insulated cavity. Diagonal tension strap bracing for horizontal loads is usually screwed or welded to rigid connection points. The straps often are loose or bent during installation and allow damaging movement to occur in the building frame during lateral loading. The bearing wall structures normally built do not provide for continuity of the concrete diaphragm topping unless it is poured separately at each floor level and cured before the next level is erected. When the steel frame is erected with the concrete topping placed after erection in the present art, the continuity of the topping is interrupted at each wall and no continuous diaphragm is possible.

Filled cavity use of light gauge steel framing has been limited to a few systems wherein metal lath is placed on an open truss steel stud frame and the cavity is filled with cement plaster in a multiple pass pneumatic placement operation. Although there is a small composite effect with these methods, the strength of the pneumatically placed cement plaster and metal lath and the composite action are insufficient to appreciably aid in penetration resistance or load capacity of the assembly. The method is very slow, it is not used for multiple story construction, does not adequately provide for lateral forces and is very labor intensive. Several such systems using pneumatic placement of cement have been unsuccessfully marketed for security construction.

A light gauge framing method with reinforced cement finishes was described in U.S. Pat. No. 4,472,919, which relates principally to a method of allowing independent movement of the steel frame and the reinforced cement finish. The method described is not appropriate for penetration resistance in security construction and does not envision any composite action.

Modular building techniques described in U.S. Pat. No. 3,751,864 claim a concrete column and beam type structure created with modular boxes with corrugated steel walls and floor used as permanent forms. This patent limits the modules to one story at a time with structural loads carried by conventionally reinforced columns and beams. Concrete is poured at each story and must cure before the next story of modules is placed. This creates many of the same problems associated with concrete construction in that the concrete placement is subject to weather considerations and all concrete must cure on each floor before the next floor modules can be set. There is no great increase in speed of construction over normal methods and the steel is not acting in a composite way.

A structure of modular units is also described in U.S. Pat. No. 3,678,638 that describes a column and beam structure of concrete formed by the module walls. The steel framing of the modules is not intended to carry any permanent loads and the structure must be erected one story at a time and requires many special parts. Due to the one floor at a time pouring and curing of concrete it will not improve construction speed.

SUMMARY OF THE INVENTION

This invention relates to a method of constructing lightweight non-combustible detention structures and multi-level structures of all types. It utilizes a light gauge steel structure that may have cementicious fill placed after enclosure of several levels of the building. Means are provided for safe, enclosed working areas and for the convenient placing of cementicious fill in each level from above or, through pressure pumping, from other points in the structure. During adverse weather conditions, construction may proceed without interruption due to pre-enclosure of working areas. This invention provides means of increasing resistance to penetration, forming of monolithically placed concrete with permanent structural parts, safely improving the speed of construction, tensioning bracing straps, facilitating continuous diaphragm slabs, supporting wall finishes at the wall base and fireproofing steel parts heretofore unknown in the art.

It is, therefore, one of the primary objects of this invention to provide an improved method of constructing monolithically poured reinforced concrete buildings utilizing permanent lightweight metal forming members that also serve as the building structure either independently or in combination with subsequently placed concrete.

Another object of the present invention is to maximize the properties of metal and cementicious materials in a structural arrangement for high resistance to penetration and impact damage for primary use in detention structures and to allow rapid enclosure of space while providing safe working surfaces composed of permanent parts of the structure and giving easy accessibility within a controlled environment for installation of piping, ducting and wiring concurrently, without interfering with each other or with other trades.

A further object of the present invention is to permit direct visual inspection of the concrete for the full height of the pour while it is being placed into permanent forms that are a part of the structural load resisting elements and to allow tensioning of lateral load resisting diagonal tension straps in a manner that simultaneously distributes some lateral loads into both understressed vertical load resisting members and moment resisting members.

A still further object is to allow placement of concrete floor topping after erection of a light gauge metal framed floor structure in a manner allowing a continuous diaphragm design and also providing backing at the base of wall finishes and to provide a lightweight wall bearing structure that distributes loads onto the foundations in a linear pattern, thereby allowing construction on low bearing capacity soils with simple slab type foundations.

Another object is to provide a light gauge, steel reinforced concrete structure that temporarily supports up to 6 levels of construction loads prior to the curing of the cementicious materials of the composite structure, the completed composite structure produced thereby providing greater load capacity and thus higher and more fire resistant structures than the light steel acting alone with surface finishes only and to provide a thermal storage mass on the conditioned air side of the enclosure to aid in the economical heating and cooling of the enclosed space.

An additional purpose is to provide a means of creating a sheathed cavity with materials that provide a stressed skin effect for the composite structure as well as a base for interior and exterior finishes and durable enclosure during construction, to provide a monolithic acoustic barrier from one side of the structural wall to the other side, and to permit cementicious fire proofing to be simultaneously placed with the wall or floor cavity cementicious fill.

A structure of light gauge metal beam or channel members is either stick built or panelized and erected upon a foundation. Sheathing material is applied to the exterior surfaces and roof framing and sub-flooring may be applied to the floor framing. Windows, doors, louvers, exterior insulations, etc., may then be installed along with a roof waterproofing, thereby providing an enclosed working environment. After erection of the first level steel structure, safe interior working areas with walking surfaces are created which allows convenient placement of wiring, piping and ducting installations within the wall and ceiling cavities. As each further level is erected, the enclosed areas formed create similar safe working areas for immediate installation of all other trade work such as wiring, piping, ducting and other work within the cavities of the walls and ceilings. Interior sheathing is applied and the wall cavity may be filled with cementicious material. Sub-flooring may be topped with cementicious material at any convenient time during the construction process after the wall cavity therebelow has been filled with cementicious materials and, where moisture sensitive finishes are used, waterproofing has been installed thereabove. The cementicious cavity fill material is placed from above at each level through special holes in the top and bottom tracks of the light gauge steel framing as each level is ready. The fill may be alternatively pumped into the wall and/or floor cavities at any convenient points using high pressure pumps. Insulation may be applied to the exterior surface of the sheathing either before panel erection or after panel erection at any convenient time, and exterior finish may then be applied over the insulation. In the construction of multi-level structures, the steel framing may be erected many levels above the previously filled and cured cementicious wall fill.

DETAILED DESCRIPTION OF THE PREFERRED EMBODIMENT

Figure 1:
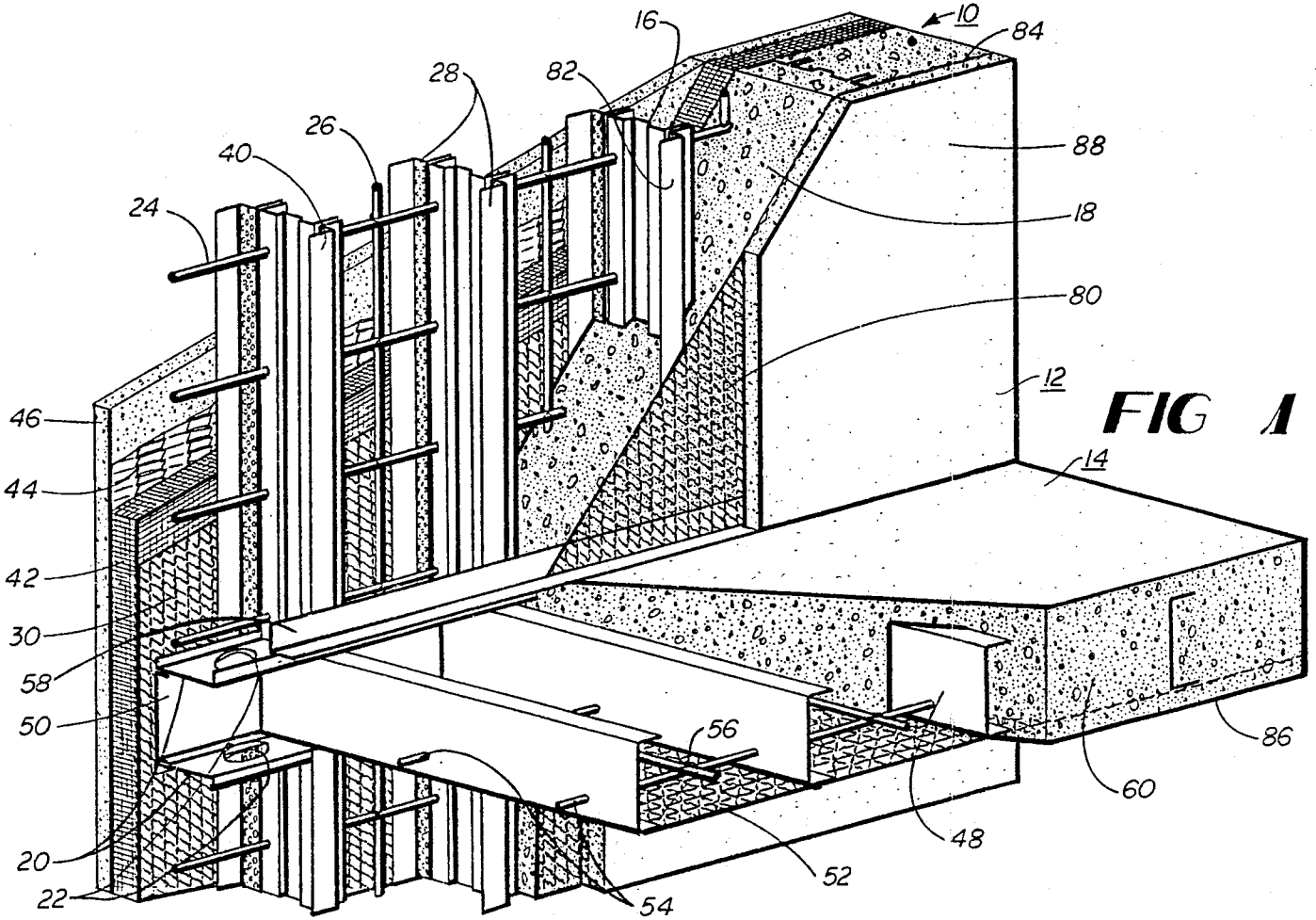
FIG. 1 is an isometric sectional view showing the components of the cementiciously filled wall and floor for a detention structure.

Referring now more specifically to the drawings, and to FIG. 1 in particular, numeral 10 designates generally an isometric sectional drawing of an exterior wall panel 12 supporting and being supported upon a floor panel 14 in a typical configuration that may be used for a detention structure. Walls 12 are built of multiple, light gauge, metal stud members or channels 16 with a central web formed for retaining cementicious fill 18. The stud members are normally 12 to 20 gauge steel or other suitable material, as are the floor joists and floor/ceiling tracks which are described hereinbelow. The stud members or channels used for the outer wall construction and the interior wall construction are generally similar. While slight variations may be used, one of the objects of the present invention is to use basically interchangeable materials. Thus, the invention utilizes generally U-shaped channels, generally C-shaped channels, and a form of corrugated channel, shown in FIG. 1 as numeral 16, which provides a central web with an offset configuration to increase the surface area thereof.

The stud members are inserted into top and bottom U-shaped tracks 20, through apertures 22 formed therein. The stud members are secured therein by welding, self-tapping screw fasteners, or other conventional means, as are the hereinbelow described metal to metal contacts at wall, ceiling and floor intersections, except as specifically noted. Horizontal reinforcing rods 24, normally of steel, are inserted through holes made therefor in the studs 16 at spacings required for security penetration and structural strength such as six to eight inches on center. Vertical reinforcing rods 26 are attached to the horizontal rods as required for structural strength and penetration resistance with similar spacings. Z-shaped furring members 28 are attached to the exterior faces of studs 16 and expanded metal lath sheathing 30 is attached to the free end flange 40 of the Z-shaped furring member. Insulation foam 42 is applied over the sheathing 30 and an outer layer of expanded metal lath sheathing 44 is fastened through the foam into the end flange 40. The above described assembly may be pre-fabricated and placed upon a load bearing surface. A cement plaster or other finish 46 is applied over the sheathing 44 on the assembly prior to or after erection. Doors and windows (shown hereinafter) may be framed and installed prior to erection as needed.

Figure 6:
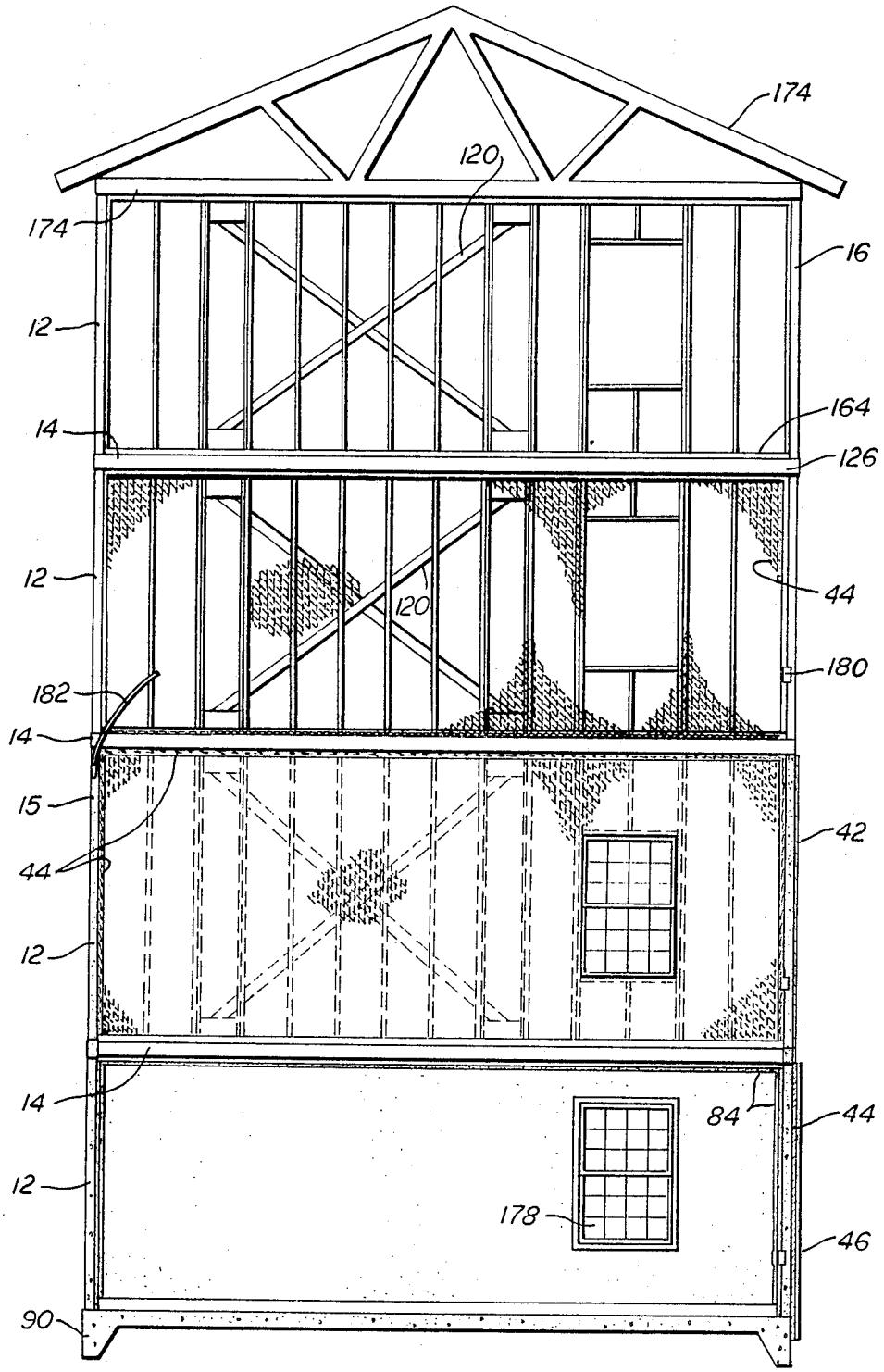
FIG. 6 is a side elevational view, shown partially in cross-section through a light metal framed multi-story structure showing the simultaneous phases of construction.

Floor/ceiling 14 is built of light gauge metal joists 48 inserted into generally u-shaped tracks 50 and fastened thereto by welding or other suitable operation. Expanded metal lath sheathing 52 is attached to the bottom of the joists 48 except where the joist will be in contact with a wall-receiving track 20 after erection. Such sheathing 52 may also be secured to the top of the joists 48 where desired. Reinforcing rods 54, perpendicular to the joists 48 may be inserted through holes in the joists or over the top of the joists and additional reinforcing rods 56 are attached to the said inserted rods 54, running parallel to the joist, as required for penetration resistance and/or structural requirements, the spacing being as described hereinabove. The above described floor/ceiling assembly may be prefabricated and placed upon the wall panel 12 and fastened thereto as described, for example, by welding or other means. The floor/ceiling assembly thus provides an upper surface which serves as a floor or deck for one level of the present building invention and a lower surface that serves as a ceiling for the level therebelow. A roof panel with roofing attached as shown in FIG. 6 may be similarly pre-fabricated and erected upon the uppermost wall track.

The above described method of panelizing floors, walls and roof and placing them in sequence can continue until the entire building frame is erected. At that point, an enclosed enviroment has been provided that allows plumbers, electricians and other mechanical tradesmen to install piping, wiring and ductwork within the spaces between joists 48 and/or studs 16 or through holes cut through the webs or the outer flange portions thereof. Upon completion of work that is installed within the walls or floor structures, additional Z-shaped furring members 28 may be installed over studs 16 and a screed angle 58 installed over the furring members at the finished height of the cementicious floor fill 60. Metal lath sheathing 80 is then attached to the interior free end flange 82 of the Z-shaped furring members 28 and angle 58. Cementicious fill 60 is then pumped into the lowest floor or wall panel through holes in the tracks 20. Placement of said fill is observed through the metal lath sheathing 80 to assure solid filling of all spaces. Cementicious floor fill 60 is then placed between joists 48 and screeded off level against screed angle 58. The above sequence is continued upon initial set of the cementicious fill on each level until the entire building has been completed. After initial set of the cementicious fill on any level a cement plaster or other finish 84 is normally applied over the cementicious fill that has extruded out through the openings in the metal lath 80. The preferred cementicious fill mix is a low slump, portland cement, pea gravel concrete that can be pumped through a small diameter fill hose that is inserted through the holes 22 in tracks 20. With a low slump concrete mixture, this preferred fill extrudes through the lath 80 sufficiently to form a superior bonding surface for subsequently applied cement plaster 84. The preferred mix for the cement plaster contains acrylic and glass or polypropylene fibers to allow a 5000 psi compressive strength for resistance to damage. A similar mix is preferred for the ceiling plaster 86 which is installed over cementicious fill that has extruded slightly through metal lath sheathing 52 below the floor joists.

Interior metal lath sheathing 80 is usually a relatively rigid rib-type lath to allow it to retain the cementicious fill without bowing due to the fluid pressure exerted on the lath during placement of the fill material. The lath 80 is a very important element in detention structures because it allows visual inspection of the fill during placement. Gaps and voids in concrete fill placed between reinforced masonry block walls, where visual inspection is not possible, have allowed prisoners to escape by finding the hollow parts. The prisoner is able to break through the masonry quickly when the core fill is defective. This invention eliminates any voids or gaps in the concrete fill.

A hard surface finish 88 is optionally applied over the cement plaster interior 84 and/or exterior finish 46 and/or ceiling plaster 86 to prevent staining. A polyurethane enamel is suitable for this purpose on the interior and an acrylic is typically used for the exterior.

The wall panels 12 may be constructed without the Z-shaped members 28 if a fire rating of one hour is all that is required. In this instance, the bearing or non-bearing studs 16 would be fire protected by the thickness of the cement plaster 84 only. Where fire ratings of up to 4 hours are desired, the depth of the perforated Z-shaped members 28 is increased to allow cementicious fill 18 to encase the studs 16 with the required thickness of fireproofing. For example, a one inch plaster covering over the studs generally provides a one hour fire rating, one and one-half inches of plaster provides a two hour rating and a two inch covering provides a four hour rating. Thus, the inherent safety of the present structure, due to the materials used in construction, can easily be enhanced.

Figure 2:
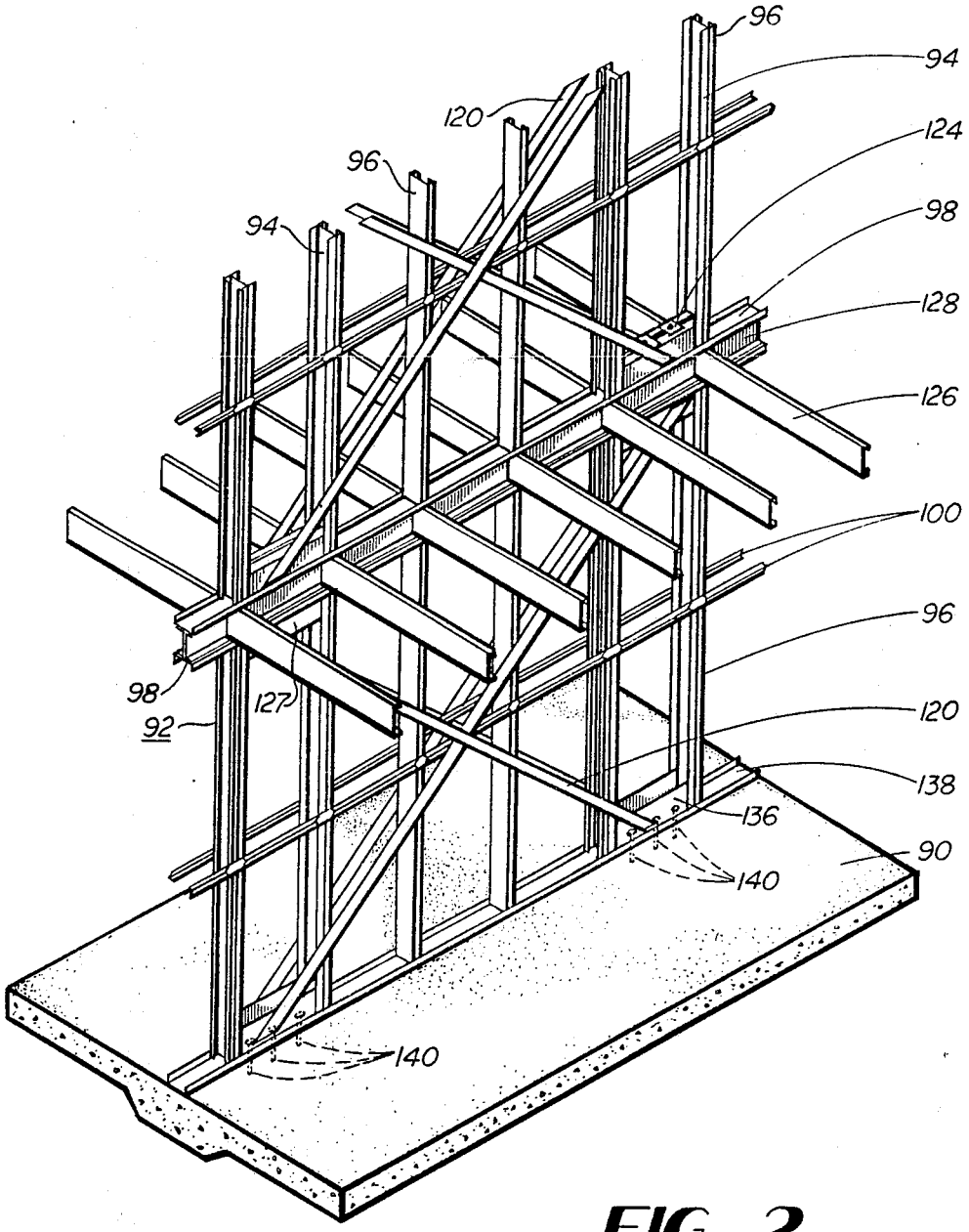
FIG. 2 is an isometric view of a light metal framed, multi-level construction showing floor, wall and diagonal tension strap framing.

FIG. 2 is an isometric view of the light gauge framing members in a multiple story structure at an interior, horizontal, load-resisting bearing wall showing foundation and first floor wall framing, portions of two floor spans, part of the second floor wall framing and the unique, horizontal load-resisting diagonal tension strap system which is a characteristic of the present invention. A slab-type foundation 90 is formed and cured to receive bearing wall panels. Other types of conventional foundations, such as concrete block, may also be used. A light gauge metal wall panel 92 is constructed of multiple light gauge bearing studs, including C-shaped studs 94 and U-shaped studs 96. The studs are inserted into and fastened to top and bottom U-shaped tracks 98 by welding or other conventional fastening means. Horizontal bridging rods 100 are fastened to each stud, again, by welding or other suitable means.

Figure 4:
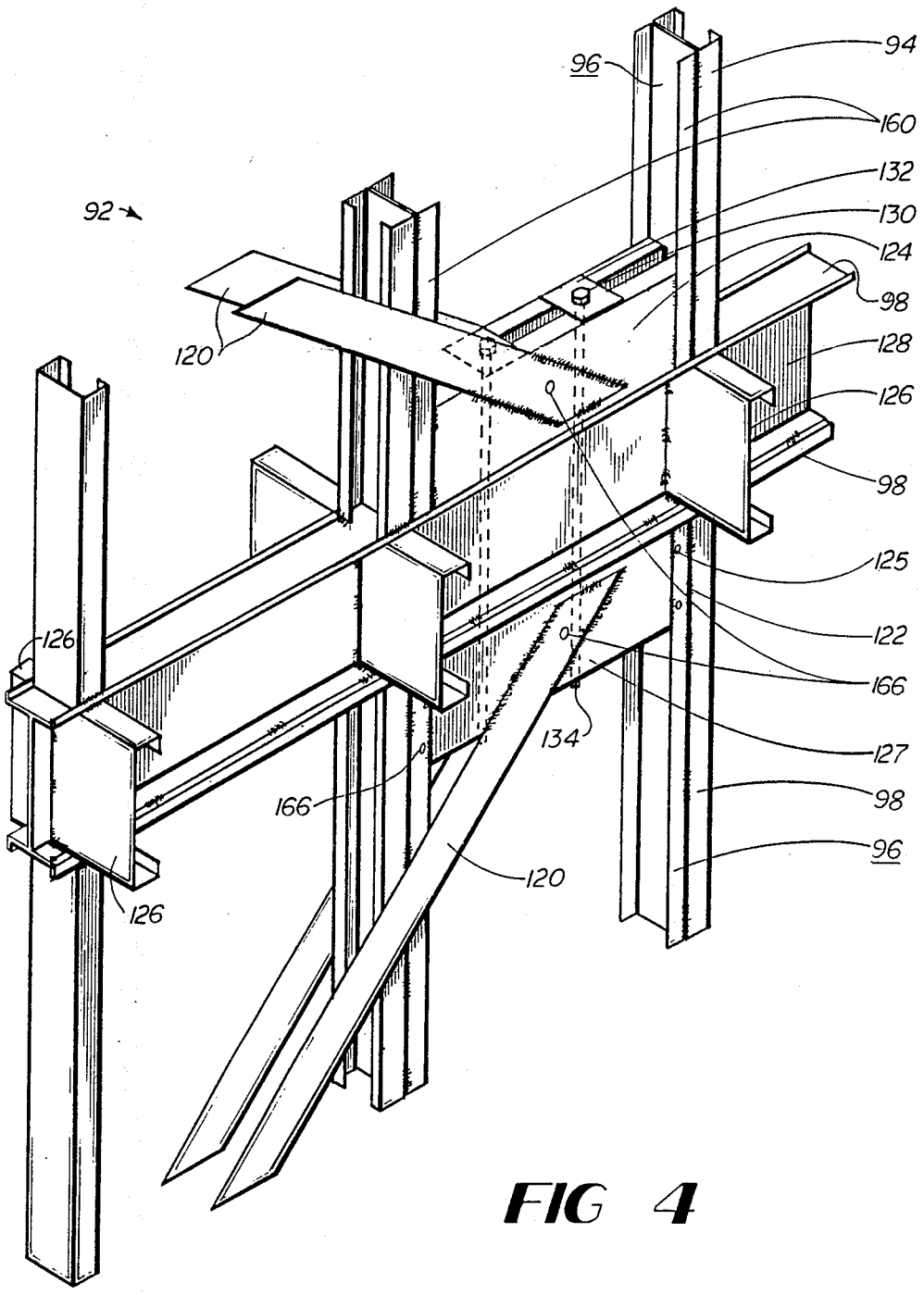
FIG. 4 is an isometric view of the diagonal strap tensioning beam connection.

As shown in FIGS. 2 and 4, the wall panel sections have diagonal tension straps 120 fastened generally between the upper and lower diagonally opposed corners thereof. As noted earlier, either the C-shaped, or corrugated studs or channels may be used as structural members. Thus, these wall panels are shown with C-shaped members running vertically. At the panel edges, however, the last two uprights on each side consist of a C-shaped stud and a U-shaped stud normally secured back-to-back at 122 with the U-shaped studs facing inwardly for accepting horizontal beam members 124 and 127, respectively, above and below the floor/ceiling frame panels, secured by welding as at 125. Floor framing panels of light gauge C-shaped joist members 126 are inserted into and fastened to U-shaped joist-receiving track members 128 at each end with appropriate bridging (not shown) between the joists, at intervals sufficient to prevent rotative movement. A space is left between the top and bottom short beams 124 and 127 and between the U-shaped joist tracks 128 over the bearing wall for receiving bolts 130. Additional wall panel and floor panel members or sections are similarly placed until the structure is to the desired height.

When the second level wall panel has been placed, the diagonal tension straps 120 on the first floor are tensioned by drawing up bolts 130 which are inserted between the horizontal beams 124 at the bottom of the second floor or upper level wall panel, through the lower and upper tracks 98, between the space left between the joist-receiving tracks 128, and then between the short beams 127 at the upper level of the first or lower level, depending on the level being erected. The bolts have washers 132 at the top and bottom ends thereof, and are secured with nuts 134. The first level diagonal wall panel straps 120 are permanently attached to U-shaped structural steel channel connector beams 136 which are secured through a U-shaped floor track 138 with bolts 140 into foundation 90.

As each additional wall panel is installed, the tension straps 120 are similarly tensioned in the panel below so that the structure is capable of resisting lateral loads as it is erected. Upon completion of the described structure, horizontal loads applied to any floor above the second causes a distribution of the horizontal load into each tension strap below, which is then transmitted into bending forces in the short horizontal beams 124 and 127. The resultant horizontal loads are thus distributed to many additional load resisting members, thereby reducing load concentrations encountered in the present art and allowing selection of lighter framing members while concomitantly reducing foundation costs. The bending moments induced into the said short beams 124 and 127 by the tension straps 120 helps to dissipate lateral load energy with reduced potential damage to the structure from seismic or wind forces.

Figure 3:
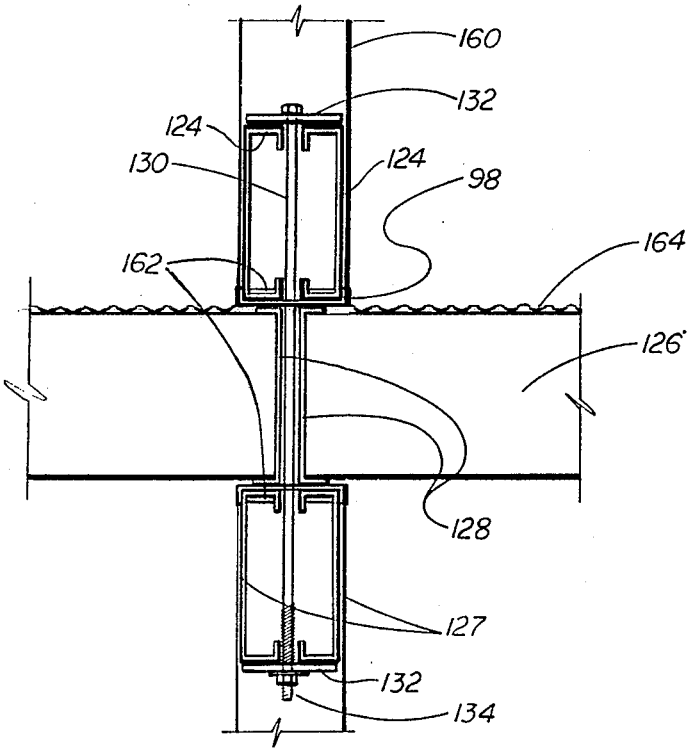
FIG. 3 is a cross-sectional detail showing the short beam tension strap connection through a floor system.

FIG. 3 is a section through the short horizontal beams 124 and 127 at the top and bottom of a wall panel, respectively and the ends of two floor panels showing the through bolts 130 used to tension the diagonal tension strapping 120. Short beam members 124 and 127 are inserted between the end flanges 160 of the U-shaped wall vertical members 96 and fastened thereto at all interfaces with a space 162 left between the short beams 124 and 127 and the wall tracks 98. Bolts 130 are inserted between short beams 124 and 127 and floor joist-receiving tracks 128 and through tracks 98 near the ends of floor joist members 126, over which is shown a corrugated decking 164. Large washers 132 are placed between bolts 130 and nuts 134 and the upper or lower ends of the short beams 124 and 127 to distribute the loads.

This invention allows the diagonal tension straps 120 to be stressed sufficiently to allow them to immediately pick up any lateral loads applied to the building. In the present state of the art, diagonal tension straps cannot be tensioned and often are bent or bowed between framing points which causes a delayed response to lateral loads with attendant undesirable movement in the building frame. Sometimes the diagonal straps in the present art are so loose that shock loads can occur in the building frame when the straps become tensioned by lateral loading. These shock loads are very damaging to fasteners and can eventually cause major structural movement to occur. The invention described herein eliminates these problems.

FIG. 4 is an enlarged, partial isometric view of the diagonal strap/short beam connection at a typical floor construction. The short beams 124 and 127 span between two vertical, U-shaped framing members 96 and are fastened between flanges 160 at each end. The beam 127 at the upper end of the wall panel is temporarily attached as with bolts (not shown) through holes 166 in flanges 160, leaving a gap 162 between the beam and the wall track 98, thereby allowing the beam to bend. Diagonal tension straps 120 are temporarily fastened through holes 166 to the upper and lower short beams 124 and 127 with a through bolt (not shown) that allows the strap 120 to pivot as the beams 124 and 127 change position upon tightening of bolts 130.

In sequence, the U-shaped structural steel channels 136 are permanently fastened before the bolts 130 are tightened. The nuts 134 are then tightened on bolts 130 until the straps 120 are tight. The temporarily fastened short beams 127 (at the upper end of the wall panel) are then permanently attached to the receiving track 96 and the strap 120 is then permanently attached to beam 127. When tension from lateral loads occurs in strap 120 above the floor, beam 124 above the floor bends upwardly and in so doing, through bolts 130, induces bending in beam 127 below the floor. This induces tension in strap 120 below the floor which is attached to the channel 136 at the base or to another beam 124 therebelow which also bends and tensions the next level's strap 120. In this manner, the majority of the lateral load is dissipated in the bending of short beams 124 and 127 throughout the structure. The balance of the lateral load is converted to tension or compression loads in vertical members 94 and 96 and retainer flanges 160 at each end of each short beam.

Figure 5:
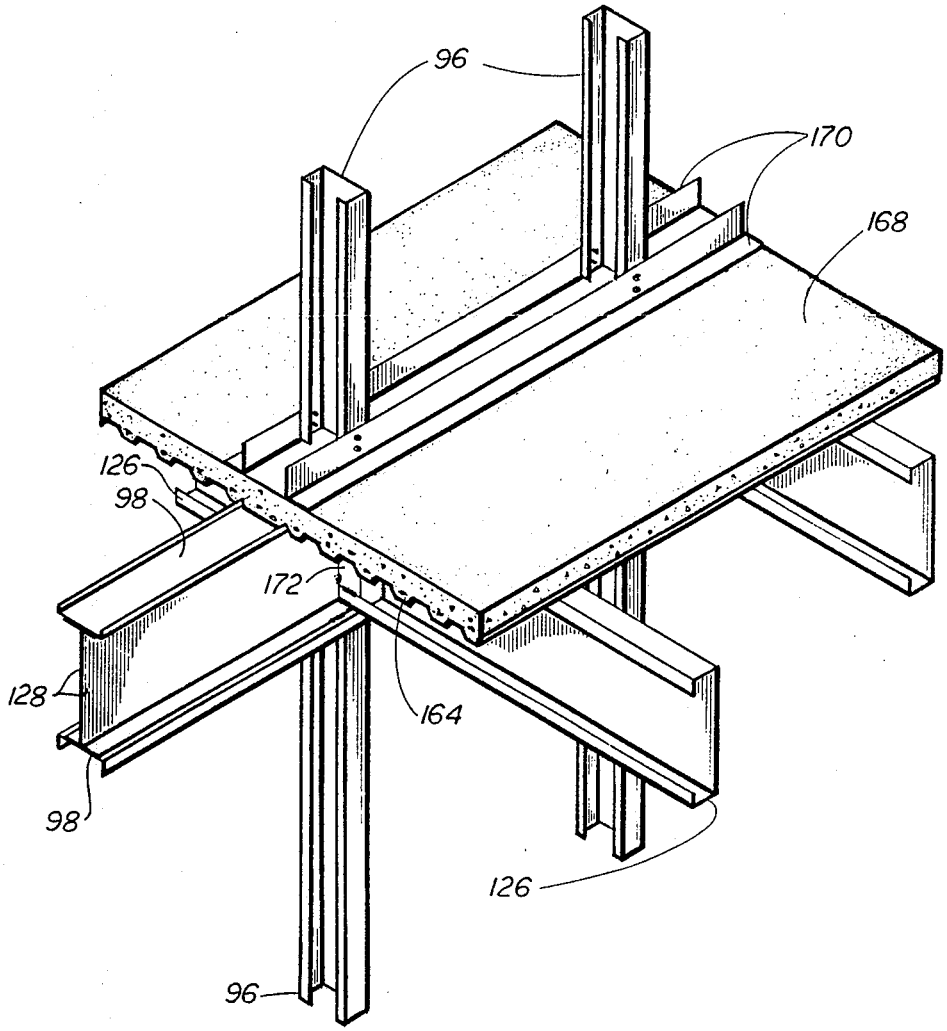
FIG. 5 is an isometric view showing the continuous diaphragm slab at a panel wall.

FIG. 5 is a partial isometric view of a continuous floor topping slab 168 at a bearing wall and floor intersection in the middle portion of a wall panel. Light metal angles 170 are fastened to vertical structural members 96 at the finished elevation of floor topping 168. The cementicious slab or topping 168 is placed upon metal sheathing/decking 164 which is fastened to the light metal floor joists 126. The ends of the joists may be braced with bearing clips 172 or angles to carry loads from studs 96. The cementicious slab 168 is poured and screeded using angle 170 as a screed. The poured fill 168 is also placed between studs 96 over the top of the track 98 to the bottom of or higher than the bottom of angle 170. This allows the cementicious fill 168 to be continuous across the base of the wall and thus forms a continuous diaphragm slab that is poured after the light gauge framing construction is completed.

A distinct advantage of this invention is that the concrete fill can be placed in environmentally controlled conditions after the entire building frame is completed and all mechanical work is roughed in. The cementicious topping thus not only is a continuous diaphragm but also seals all piping and duct work that may project between floors. The topping also forms an excellent acoustic and fire stop within the wall cavity. There are no delays in construction while topping is curing because the next floor topping can be placed while the lower floors are still setting, due to the structural integrity of the metal framing. The time savings, cost savings and improvement in structural quality of the completed building are very important improvements over the prior art. Also, the screed angles 170 provide backing for wall finishes, such as gypsum or wall board to be applied later and, when concrete fill is placed higher than the floor surface of slab 168 between the angles 170, an excellent acoustic seal is provided at the base of the wall, as opposed to the high sound transmission between floors and opposed walls in conventional structures.

FIG. 6 is a side elevational and partial cross-sectional view of a light metal frame, multiple story structure showing the simultaneous phases of construction. Wall panels are erected upon foundation slab 90 and fastened thereto as shown in FIG. 2. Wall panels consist of studs 16, 94, or 96, diagonal straps 120, insulation 42 and finished exterior cement plaster 46 on metal lath 44. Floor panels 14 are installed and fastened on top of wall panels 12. Floor panels 14 consist of joist members 126 and decking 164. Second story wall panels 12 are then erected upon the first floor panel 14 and fastened thereto. The third story floor panel 14 then is placed upon second story wall panel 12 and fastened. The third story wall panel 12 next is fastened on top of the third story floor and the fourth story floor is fastened on top of the third story wall. The fourth story wall is then erected over the fourth story floor and a roof truss 174 is placed upon the uppermost wall. Roofing 176 is then installed after erection of truss 174 and an enclosed environment has been created in a very short time with insulated walls, walkable deck surfaces and waterproof roof.

Where the wall panels 12 are to be left hollow, as in a non-security structure, windows 178 and/or doors, (not shown) can be framed and installed prior to the wall panel erection. Where all wall and floor panels are to be filled with cementicious fill after erection, as in a detention structure, temporary closures may be provided over the window openings until the cementicious fill has been completed. After the metal frames of the first story floor, walls, and ceiling have been erected, electrical and plumbing conduits 180 may be installed while the upper levels are being erected. Upon completion of electical and similar work on each level, metal lath/sheathing 44 is attached and the wall cavities filled with cementicious fill 18 through a fill hose 182 inserted from above through holes 22 in the stud tracks. Upon initial set of fill 18, windows 178 are installed and interior finish 84 is placed.

After the interior finish is completed, base trims, window trims and finish electrical and mechanical work may be done. Using the simultaneous activities possible with this invention, a 4 level building as illustrated in FIG. 6 may be completed in 5 weeks or less after the foundation has cured and any number of levels are possible within similar short schedules. The safe, dry and convenient work areas, simple consistent materials, and short erection time allows construction of high quality, low cost buildings.

Figure 7B:
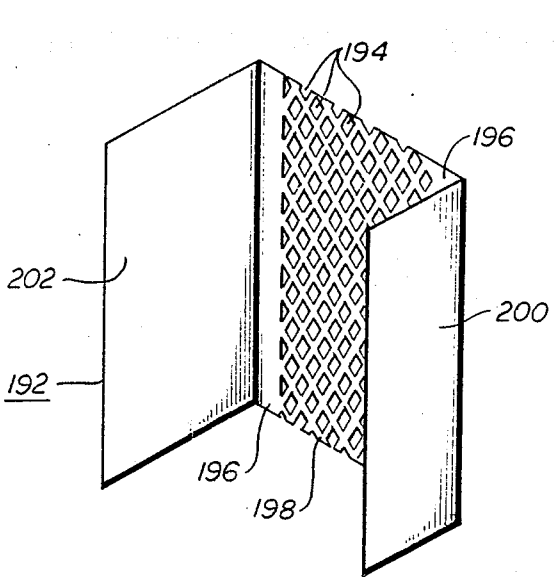
FIG. 7 is an isometric view of Z shaped and C shaped edge and corner furring members, respectively showing one possible perforation pattern for the web portions thereof.
Figure 7A:
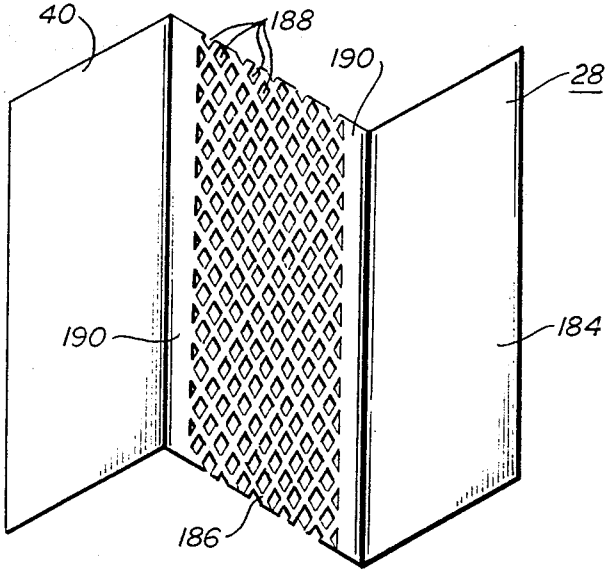

FIG. 7A shows an isometric view of a typical Z-shaped furring member 28 made of light gauge metal. This member is used to separate the metal lath or sheathing from the light gauge metal structural members so that cementicious wall or floor/ceiling fill can encase the said structural member during filling operations as previously described. An inside flange 184 is formed to receive fasteners that attach the sheathing to the vertical studs or horizontal floor joists in the wall or floor system. Flange 184 may be any convenient dimension required by the type of fasteners used. For screw type fasteners, flange 184 is usually $\frac{3}{4}''$ to 2" wide. The web 186 or central portion of the Z member is perforated, punched or formed with openings 188 and with a short section of non-perforated metal 190 at the web/-flange transition. The perforations 188 may be any shape desired that allows the cementicious fill to penetrate the opening but not freely run through it and that keeps direct metal conduction paths from flange to flange as long as possible. The non-perforated web section 190 is usually $\frac{1}{4}''$ wide, but may be from $\frac{1}{8}''$ to $\frac{1}{2}''$ as required, to provide stiffness to the flanges. Outer flange 40 may be any convenient dimension required by the type of fasteners used to attach the metal lath thereto. For screw type fasteners, flange 40 is usually $\frac{3}{4}''$ to 2" wide. The entire Z-shaped member is formed from the lightest gauge metal, usually 20 to 30 gauge, that will support the liquid pressure (normally 200–300 pounds per square foot) of the cementicious fill and not deform during placement of lath/sheathing and the cementitious fill.

FIG. 7B shows an isometric view of a typical C-shaped furring member 192 made of light gauge metal. This member is used at the ends or corners of panels and functions the same as the Z-shaped member shown in FIG. 7A. Perforations 194 and solid sections 196 of the web 198 are as described for FIG. 7A. The outer flange 200 is formed shorter than the inner flange 202 to allow fasteners to be placed through flange 202 directly from the front. Flange 200 is usually from $\frac{1}{2}''$ to $1\frac{1}{2}''$ wide and flange 202 from 1" to 2" wide although narrower or wider dimensions may be used for either. Other features are as described for the Z member in FIG. 7A.

Figure 8:
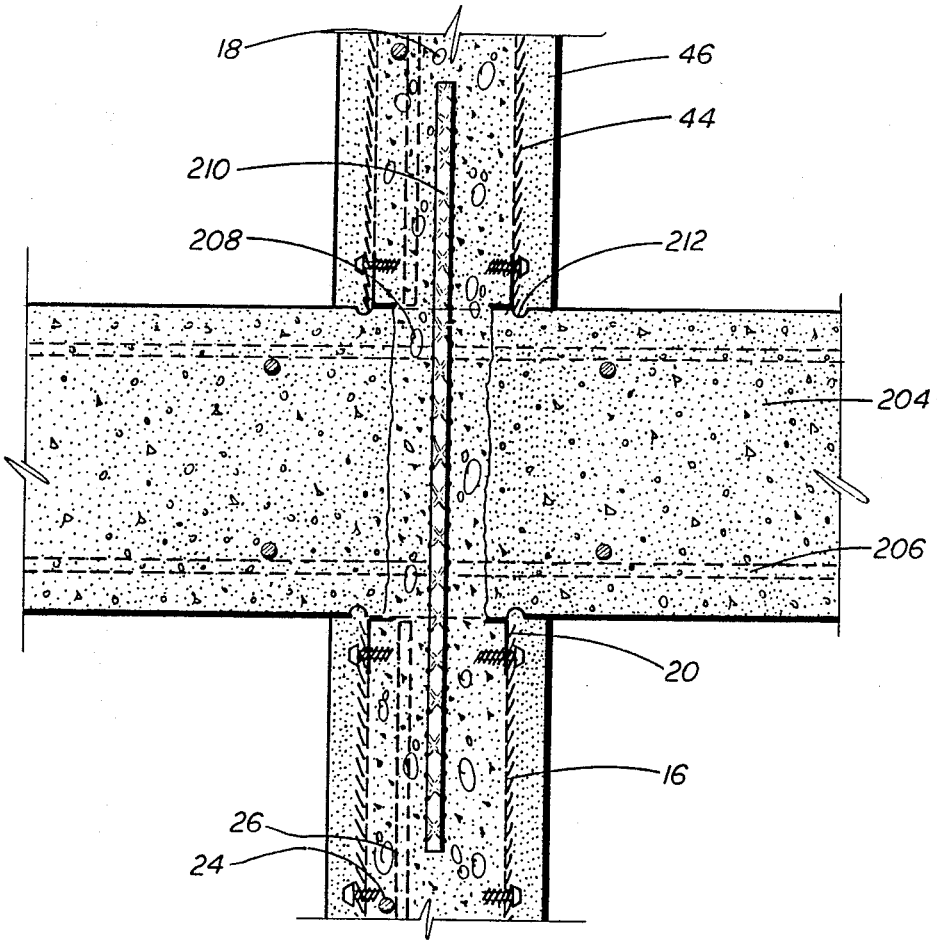
FIG. 8 is a sectional view through the floor/wall connection where pre-cast concrete slabs are used for floor construction.

FIG. 8 shows an alternate method of constructing the floor panel using a pre-cast, reinforced concrete slab 204, reinforced with rods 206, with holes 208 cast into it directly over the holes 22 in the wall tracks 20. In this embodiment, the wall panels are constructed as described at FIG. 1 with studs 16, tracks 20 and reinforcing 24 and 26, except that the screed angle may be eliminated where floor topping is not required. The cementicious wall fill 18 is placed thru the holes 208 in the slab and tracks 20 into the wall panel below and up to the top of the pre-cast slab floor 204. Dowel rods 210, normally of steel, are then inserted into the cementicious fill while it is in the plastic condition and allowed to project up to the next level wall panel. These dowel rods 210 are designed to hold the panels together as a monolitic structure. When the pre-cast floor slab alternative is used, a groove 212 is cast into the top and bottom of the slab within the area of contact of the cement plaster finish 46. The cement plaster 46 penetrates the grooves during placement and thus still provides the important feature of a jointless cell interior. Joints in normal pre-cast concrete construction allow prisoners a place to hide contraband and said joints are also subject to vandalism requiring frequent repair. With this embodiment, all joints in the cell interiors are eliminated.

This invention provides a more economical and quick way to build improved detention structures that have high resistance to escape penetration while maintaining the non-combustible ratings required for fire safety. This invention also provides a means of easily constructing all types of multi-level buildings with efficient multiple function use of materials. It allows simultaneous construction operations with safe construction occupancy of lower levels while structure erection is still underway above. For most wall bearing structures, this invention allows many levels of construction to be built much quicker at a cost savings of at least 25% over standard construction.

The above description shall not be construed as limiting the ways in which this invention may be practiced but shall be inclusive of many other variations that do not depart from the broad interest and intent of the invention.

I claim:

1. A method of constructing a light gauge metal reinforced concrete structure upon a foundation comprising the steps of:

(a) erecting a first level of said structure, said first level including a plurality of light gauge metal framed wall panels having an upper end and a base upon said foundation, by securing said bases to said foundation for forming a framed enclosure;

(b) securing a floor/ceiling member to said upper ends of said wall panels for providing a ceiling over said first level and a floor for a succeeding level;

(c) placing exterior sheathing over said wall panels for enclosing said first level;

(d) loosely fastening a diagonally extending tension strap between said upper end and said base of each of said wall panels;

(e) erecting a second level of said wall panels over said first level wall panels for forming a second story framed enclosure;

(f) tightening said diagonal tension straps of said first level for resisting lateral loads on said wall panels;

(g) erecting successive levels in sequence as detailed in steps a through f for constructing a multi-story structure to a desired height; and (h) installing a roof assembly over said structure.

2. The method as defined in claim 1 including the additional steps of attaching interior sheathing to said wall panels and forming cavities between said interior and exterior sheathing, and pumping cementicious fill into said cavities for providing a solid wall structure.

3. The method as defined in claim 1 including the additional step of installing piping, wiring, and ductwork within the framework provided by said wall panels.

4. The method as defined in claim 3 including the additional steps of attaching interior sheathing to said wall panels and forming cavities between said interior and exterior sheathing, and pumping cementicious fill into said cavities for providing a solid wall structure, after said installing of piping, wiring, and ductwork.

5. The method as defined in claim 4 including the additional step of installing reinforcing means in said cavities prior to pumping said cementicious fill therein.

6. The method as defined in claim 1 including the additional steps of attaching interior sheathing to said wall panels and forming cavities between said interior and exterior sheathing, pumping cementicious fill into said cavities of said first level, and then sequentially pumping cementicious fill into each succeeding level when said fill in the level therebelow has cured.

7. A method of tensioning diagonal tension straps in a multi-story building structure having generally rectangular wall panels formed from spaced, vertically disposed metal framing members with vertical track members secured between two opposed framing members of said wall panels, such that said track members face one another, said multi-story building having floor/ceiling intersections formed by horizontally disposed structural members secured to said vertical framing members at each succeeding level, said method comprising the steps of:

(a) placing short horizontal beams into said track members within said framed wall panels at each of said floor/ceiling intersections both above and below said intersections and placing short horizontal beam members between said track members near the base of the first story wall panels, thereby providing lower beams above the floor/ceiling intersections at floor level and upper beams below the floor/ceiling intersection at ceiling level with said beams spanning between said track members;

(b) fastening said lower beams with permanent fasteners to resist strain and fastening said upper beams with temporary fasteners to resist tension applied to said diagonal straps during the erection operation;

(c) attaching a diagonal tension strap to both upper and lower short beams, the lower end of said strap being permanently fastened to said beam at floor level and the upper end of said strap being secured to said beam at ceiling level with temporary fasteners capable of resisting the tension to be applied to said straps during the fabrication of the structure;

(d) inserting bolts between said beams at floor level and at ceiling level;

(e) tightening nuts on said bolts until said diagonal tension strap is tightly tensioned; and (f) permanently fastening said upper short beam to said track members and permanently fastening said diagonal tension strap to said upper beam to resist lateral loads on said structure.

* * * * *